US007370643B2

(12) United States Patent
Hanawa

(10) Patent No.: US 7,370,643 B2
(45) Date of Patent: May 13, 2008

(54) INTERNAL COMBUSTION ENGINE HAVING COMPRESSED AIR SUPPLY PASSAGES THEREIN FOR ROUTING COMPRESSED AIR TO CHARGE INJECTORS

(75) Inventor: Kaoru Hanawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 72 days.

(21) Appl. No.: 11/391,603

(22) Filed: Mar. 28, 2006

(65) Prior Publication Data

US 2006/0219228 A1 Oct. 5, 2006

(30) Foreign Application Priority Data

Mar. 30, 2005 (JP) ..... 2005-096966

(51) Int. Cl.
*F02B 33/00* (2006.01)
*F02M 23/00* (2006.01)

(52) U.S. Cl. ..... 123/531; 123/533; 123/559.1

(58) Field of Classification Search ..... None
See application file for complete search history.

(56) References Cited

U.S. PATENT DOCUMENTS 3,285,233 A * 11/1966 Jackson ..... 123/463
5,041,034 A * 8/1991 Sakamoto ..... 440/76
5,094,217 A * 3/1992 Kaku et al. ..... 123/533
5,216,996 A * 6/1993 Kato ..... 123/533
5,233,952 A * 8/1993 Isaka ..... 123/179.17
5,375,578 A * 12/1994 Kato et al. ..... 123/516
5,495,839 A * 3/1996 Samejima et al. ..... 123/478
5,546,908 A * 8/1996 Stokes ..... 123/480
5,598,827 A * 2/1997 Kato ..... 123/518
6,238,258 B1 * 5/2001 Ozawa ..... 440/88 R
6,668,546 B2 * 12/2003 Hayman et al. ..... 60/284
6,688,288 B1 * 2/2004 Houston et al. ..... 123/456

FOREIGN PATENT DOCUMENTS

JP 2004-301113 10/2004

* cited by examiner

*Primary Examiner*—Thomas Denion
*Assistant Examiner*—Douglas J. Duff
(74) *Attorney, Agent, or Firm*—Carrier, Blackman & Associates, P.C.; William D. Blackman; Joseph P. Carrier

(57) ABSTRACT

A V-type internal combustion engine includes cylinder heads having respective compressed-air supply channels extending therein for providing fluid communication between an air compressor and charge injectors. Formation of condensation in the compressed-air supply channels is prevented. Charge injectors are provided in the respective cylinder heads, for directly injecting charges of fuel-air mixture into combustion chambers in cylinders. Compressed-air supply channels extend from an air compressor to the respective charge injectors, including a shared channel provided in a crankcase, and branched supply channels provided in each of the respective cylinder blocks. The compressed-air supply channels are internal conduits formed by attaching the cylinder blocks to the crankcase. In addition, cooling of the compressed air in the compressed-air supply channels is prevented during engine operation, so that formation of condensation within the compressed-air supply channels is prevented.

12 Claims, 6 Drawing Sheets

INTERNAL COMBUSTION ENGINE HAVING COMPRESSED AIR SUPPLY PASSAGES THEREIN FOR ROUTING COMPRESSED AIR TO CHARGE INJECTORS

CROSS-REFERENCE TO RELATED APPLICATIONS

The present invention claims priority under 35 USC 119 based on Japanese patent application No. 2005-096966, filed on Mar. 30, 2005. The subject matter of this priority document is incorporated by reference herein.

BACKGROUND OF THE INVENTION

1. Field of the Invention

The present invention relates to a multi-cylinder V-type internal combustion engine. More particularly, the present invention relates to a multi-cylinder V-type internal combustion engine provided with charge injectors which directly inject a fuel-air mixture into combustion chambers of the cylinders, in which routing passages are provided to route compressed air to the charge injectors.

2. Description of the Background Art

It is well known to provide an internal combustion engine, used as a power source for a vehicle such as a motorcycle, with charge injectors which directly inject fuel-air mixture into combustion chambers in cylinders. Such an internal combustion engine is disclosed, for example, in Japanese Patent Laid-Open No. 2004-301113.

In such internal combustion engines, the opening and closing of the charge injectors are controlled in accordance with the cycle of combustion operation of the internal combustion engine, and the charge injectors mix fuel and compressed air supplied from an air compressor, and inject the mixture into the combustion chambers to allow the internal combustion engine to operate. The charge injectors make it possible to achieve improved fuel efficiency during operation of the internal combustion engine.

In addition, a V-type internal combustion engine is a well known type of internal combustion engine in which a plurality of cylinders are provided on a crankcase such that the plurality of cylinders spaced apart from each other in a V-shaped configuration. The V-type internal combustion engine is advantageous since it is possible to make the internal combustion engine more compact, and to reduce vibration accompanying the operation of the internal combustion engine, for example. In particular, for vehicles such as motorcycles in which the mounting space for the internal combustion engine is limited, use of the V-type internal combustion engine is considered to be an appropriate choice.

The charge injectors are provided in a cylinder head portion of the internal combustion engine. Placement of the charge injectors in this location creates the problem of determining how to provide compressed-air supply channels which extend from the air compressor, annexed to the internal combustion engine, to the charge injectors.

Specifically, there has been a problem with regard to V-type internal combustion engines, since compressed air has to be supplied from the air compressor to respective head portions of the cylinders which are spaced apart from each other due to the V-shape. As a result, the assembly structure of the internal combustion engine becomes complicated due to the design of the compressed-air supply channels unless the disposition, branching or the like of the compressed-air supply channels is contrived.

In particular, with regard to the V-type internal combustion engines, there has been a problem that the compressed-air pressures become uneven between respective head portions of the cylinders, and the fuel mixing ratios in the charge injectors therefore become uneven unless the lengths of the compressed-air supply channels extending from the air compressor to the head portions (the charge injectors) of the respective cylinders are made even.

In addition, when the compressed-air supply channels are excessively cooled as the vehicle travels, the moisture contained in the compressed air condenses to form dew in the compressed-air supply channel. This is problematic since this dew can cause a malfunction of the charge injectors and operational failure of the internal combustion engine.

Meanwhile, although the compressed-air supply channels should not to be excessively cooled, the air compressor annexed to the internal combustion engine is required to be easily cooled as the vehicle travels in order to increase the air compression efficiency. Accordingly, the realization of a V-type internal combustion engine which satisfies the above conflicting demands and can solve the above problems is desirable.

The present invention has been made in consideration of the above current circumstances, and an object thereof is to provide a V-type internal combustion engine having a structure that can be easily assembled even if the compressed-air supply channels extend from the air compressor, which is annexed to the internal combustion engine, to the charge injectors in a contrived manner.

Another object of the present invention is to provide, in the same way, a V-type internal combustion engine in which respective lengths of the compressed-air supply channels extending from the air compressor to the charge injectors are made even.

Still another object of the present invention is to provide, in the same way, a V-type internal combustion engine of which the compressed-air supply channels are not excessively cooled even when the internal combustion engine is cooled as the vehicle travels, and which thus makes it possible to prevent condensation in the compressed-air supply channels from occurring.

Yet another object of the present invention is to provide, in the same way, a V-type internal combustion engine, including the air compressor annexed thereto, that is cooled as the vehicle travels, and which thus makes it possible to increase the air compression efficiency of the air compressor.

SUMMARY

A V-type internal combustion engine according to the present invention includes a plurality of cylinders provided on a crankcase with the plurality of cylinders spaced apart from each other in a V-shape. The engine includes a charge injector, which directly injects a fuel-air mixture into a combustion chamber in the cylinder, provided in each of the cylinder heads. The engine also has an a air compressor annexed thereto. The invention is characterized in that part of the compressed-air supply channels, which supply compressed air from the air compressor to the charge injectors, are provided in the form of a shared channel in a crankcase portion.

Accordingly, since part of the compressed-air supply channels extend from the air compressor to the charge injectors are provided in the form of a shared channel in the crankcase portion, the compressed-air supply channels, branched to the respective charge injectors, are integrated to the extent possible, and the V-type internal combustion engine, provided with the compressed-air supply channels, can be assembled by only attaching the cylinder blocks to the crankcase.

It should be noted that, in the present invention, although it is possible to make part of, or the whole of, the compressed-air supply channels extending from the air compressor to the charge injectors in the form of external piping annexed to the internal combustion engine, it is preferable to make the compressed-air supply channels in the form of internal conduits (internal passages) formed in the crankcase and the cylinder blocks. The internal conduit structure allows the compressed-air supply channels to be warmed by the heat of combustion during the operation of the internal combustion engine, whereby it is possible to prevent condensation.

In a further aspect of the invention, the V-type internal combustion engine is characterized in that the compressed-air supply channels, extending from the shared channel provided in the crankcase portion to the respective charge injectors, are branched to the respective cylinders. In addition, the branched compressed-air supply channels are provided along side walls of the respective cylinder blocks on the sides thereof which face each other, preferably provided in the form of internal passages.

Accordingly, the compressed-air supply channels, which are branched from the shared channel in the crankcase portion, reach the respective charge injectors having even channel lengths, so that the respective pressures of the compressed air supplied to the charge injectors are made even.

In addition, even if the V-type internal combustion engine is mounted on a motorcycle, and the motorcycle travels, the compressed-air supply channels formed within the cylinder block portions are shielded by the cylinder block walls, so that the compressed-air supply channels are prevented from being exposed to the wind caused by vehicle travel and thus cooled, which also makes it possible to prevent condensation.

In a further aspect of the invention, the V-type internal combustion engine is characterized in that the air compressor is provided, in an exposed manner, on a portion of the engine corresponding to a front portion with respect to a travel direction of a vehicle when the V-type internal combustion engine is mounted on the vehicle.

Accordingly, if the V-type internal combustion engine is mounted on a motorcycle, and the motorcycle travels, the air compressor is exposed to the wind caused by vehicle travel and thus cooled, so that the air compression efficiency of the air compressor can be increased.

According to the present invention, since the V-type internal combustion engine is configured such that part of the compressed-air supply channels extending from the air compressor to the charge injectors are provided in the form of the shared channel in the crankcase portion, it is possible to easily assemble the V-type internal combustion engine having the compressed-air supply channels. This is accomplished by attaching the cylinder blocks to the crankcase. In addition, the shared channel is made in the form of an internal passages formed within the crankcase, so that it is possible to warm the compressed-air supply channels, and it is thus possible prevent condensation.

In addition, according to the present invention, the compressed-air supply channels extend from the shared channel, provided in the crankcase portion, to the respective charge injectors. Since the compressed-air supply channels are branched to the respective cylinders, and the branched, compressed-air supply channels are provided along side walls of the respective cylinder blocks on the sides thereof facing each other, the lengths of the compressed-air supply channels reaching the respective charge injectors can be made even. In addition, even if the V-type internal combustion engine is mounted on the motorcycle, and the motorcycle travels, it is possible to prevent the compressed-air supply channels in the cylinder block portions from being exposed to the wind caused by vehicle travel and thus cooled. In addition, it is thus possible to prevent condensation. Moreover, since the compressed-air supply channels are made in the form of internal passages formed in the cylinder blocks, it is possible to warm the compressed-air supply channels, and it is thus possible to prevent condensation.

In addition, according to the present invention, since the air compressor is provided in an exposed manner, on a portion of the engine which corresponds to a front portion with respect to the travel direction of a vehicle, it is possible to expose the air compressor to the wind caused by vehicle travel whereby the air compressor is cooled, so that the air compression efficiency of the air compressor is increased.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

DETAILED DESCRIPTION

Figure 6:
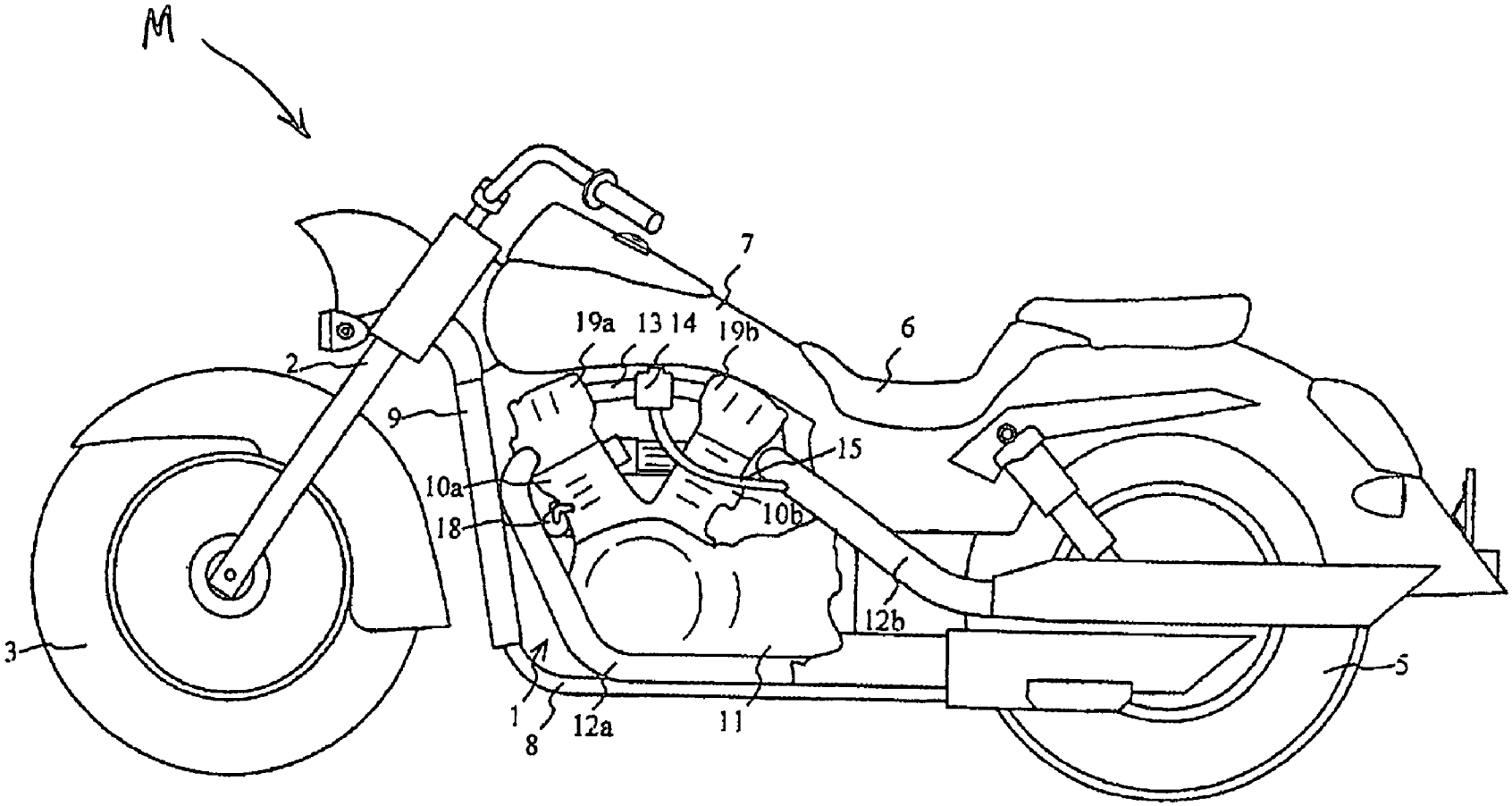
FIG. 6 is a side view of a motorcycle on which the V-type internal combustion engine according to the embodiment of the present invention is mounted showing the air compressor annexed to a front surface of the internal combustion engine.

A selected illustrative embodiment of the invention will now be described in some detail, with reference to the drawings. It should be understood that only structures considered necessary for clarifying the present invention are described herein. Other conventional structures, and those of ancillary and auxiliary components of the system, are assumed to be known and understood by those skilled in the art. Concrete description will be given of a V-type internal combustion engine 1 according to the illustrative embodiment of the present invention, with the use of an example in which the V-type internal combustion engine is mounted on a motorcycle M (FIG. 6). Throughout the description, references to "front" and "rear" directions are to be interpreted with respect to the travel direction of the motorcycle as viewed by an operator thereof.

The motorcycle M, on which the V-type internal combustion engine 1 of this example is mounted, is illustrated in FIG. 6. The motorcycle M has a front wheel 3 freely rotatably supported on a shaft at the lower end of a front fork 2. The front fork 2 is pivotally supported by a body frame. The motorcycle M has a rear wheel 5 freely rotatably supported on a shaft at the rear end of a rear fork. The front end of the rear fork is supported by the body frame such that the rear fork swings freely in a vertical direction.

A fuel tank 7, which is attached to the body frame, is provided between the front fork 2 and a seat 6. The V-type internal combustion engine 1, which is supported by a hanger 8 of the body frame, is provided under the fuel tank 7. A radiator 9 is provided on the hanger 8, and this radiator is filled with liquid coolant for cooling the V-type internal combustion engine 1.

The V-type internal combustion engine 1 has a structure in which a plurality of cylinders (two cylinders 10*a*, 10*b* in this example), spaced apart from each other in a V-shape, are provided on a crankcase 11. A front cylinder 10*a* is located on the front side of the engine 1, and is inclined toward the front. A rear cylinder 10*b* is located on the rear side of the engine 1, and is inclined toward the rear. Exhaust pipes 12*a*, 12*b* extend rearward from the front and rear cylinders 10*a*, 10*b*, respectively.

An intake feed pipe 13 connected to the cylinders 10*a*, 10*b* is disposed in the V-shaped space between the two cylinders, also referred to herein as the V bank space, which exists between the cylinders 10*a* and 10*b* of the V-type internal combustion engine 1. A control valve 14 of an exhaust gas recirculation (EGR) system is also disposed in the V-shaped space, for recirculating exhaust gas into combustion chambers of the internal combustion engine 1 in order to reduce nitrogen oxides (NOx) in the exhaust gas.

It should be noted that the exhaust gas is introduced to the EGR control valve 14 from the exhaust pipe 12*b* of the rear cylinder 10*b* through an exhaust-gas introducing pipe 15. In addition, it should be noted that by controlling the opening and closing of the control valve 14 via a solenoid in a well-known manner, the exhaust gas introduced from the exhaust-gas introducing pipe 15 is supplied to intake ports of both of the cylinders 10*a*, 10*b*, and is recirculated into the combustion chambers thereof.

An air compressor 18 is provided, in an exposed manner, on the engine in front of the front cylinder 10*a*. The air compressor 18 is located on the front side of the engine 1. The air compressor 18 is driven by the V-type internal combustion engine 1. The air compressor 18 supplies compressed air to charge injectors 30 (see FIG. 1), which are provided within the cylinder head cover portions 19*a*, 19*b* of the respective cylinders 10*a*, 10*b*, in order to directly inject timed charges of fuel-air mixture into the combustion chambers in the cylinders.

Specifically, the air compressor 18 takes in and compresses air which has been passed through an air filter (not shown), and supplies the compressed air to the charge injectors 30 through a supply channel, to be described later. The charge injectors 30 mix a proper, controlled amount of fuel with the compressed air, and directly inject the mixture into the combustion chambers at timed intervals.

Since the air compressor 18 is disposed in front of the cylinder 10*a*, which in turn is located on the front side of the engine as shown in this example, the air compressor 18 is cooled by the wind caused by vehicle travel. If air is compressed by an air compressor that has been heated to a high temperature, the air within the compressor is also heated, and it therefore becomes harder to compress the heated air, and difficult to obtain high compression efficiency. In comparison, the cooled air compressor 18 of the present invention makes it possible to obtain high compression efficiency.

With regard to the V-type internal combustion engine 1, it is often the case that the V-shaped space created between the front and rear cylinders 10*a*, 10*b* is used as a place for installing accessories. Since the air compressor 18 is disposed in front of the front cylinder 10*a* as described above, it becomes possible to realize a more compact V-type internal combustion engine in which the V-shaped space is narrowed.

Figure 1:
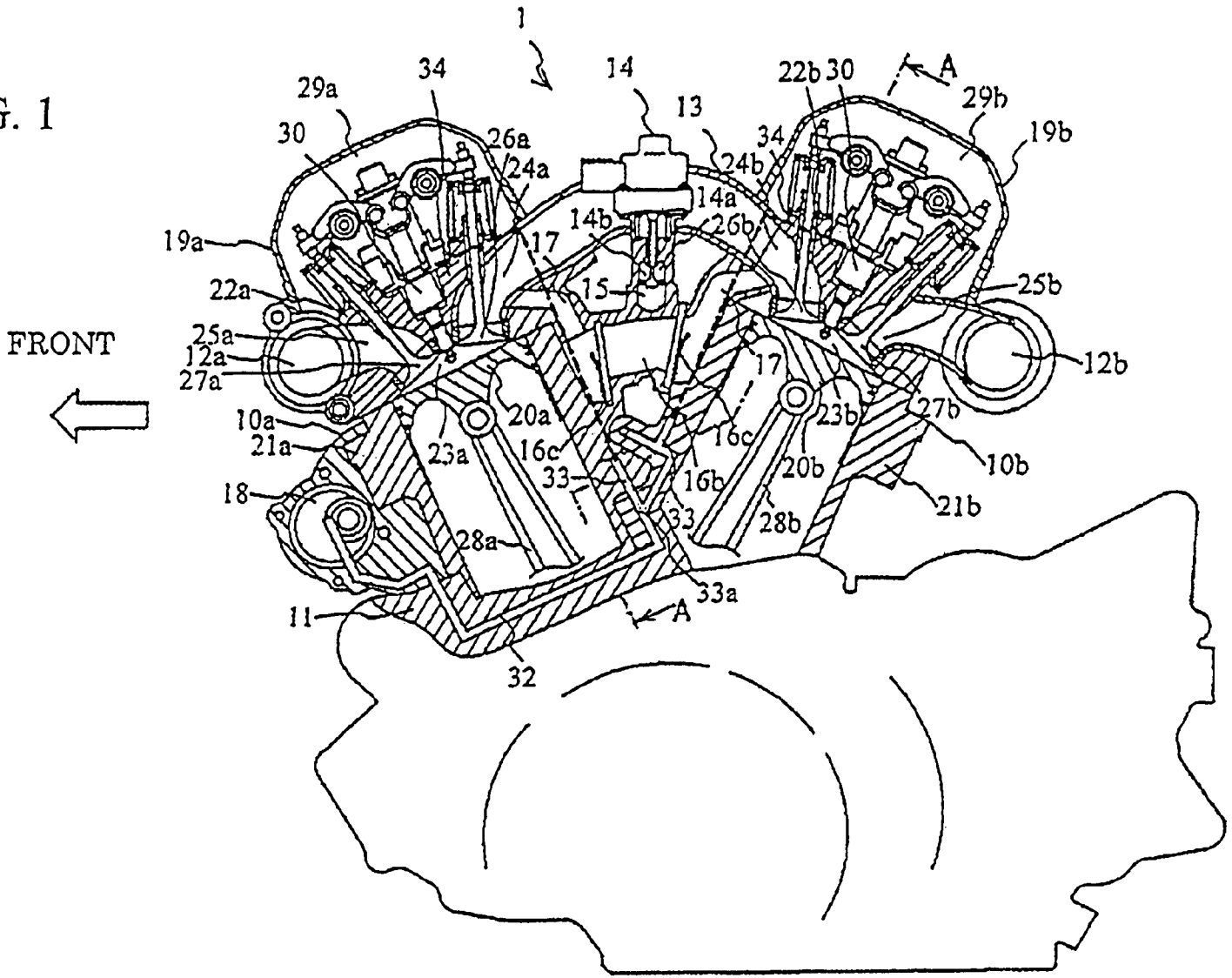
FIG. 1 is a partial cross-sectional side view of a V-type internal combustion engine according to an embodiment of the present invention showing the air compressor annexed to a front surface of the internal combustion engine, and showing compressed air passageways formed within the cylinder block.

In FIG. 1, the V-type internal combustion engine 1 of this example is shown in a partially sectional side plan view.

In the cylinders 10*a*, 10*b*, the combustion chambers 23*a*, 23*b* are formed by providing cylinder heads 22*a*, 22*b* on the upper ends of cylinder blocks 21*a*, 21*b* which freely slidably house pistons 20*a*, 20*b*. The pistons 20*a*, 20*b* are connected, via connecting rods 28*a*, 28*b*, to a crankshaft which is housed in the crankcase 11. At least one intake port 24*a* (24*b*) and at least one exhaust port 25*a* (25*b*) are opened to each combustion chamber 23*a* (23*b*). The intake ports 24*a*, 24*b* and the exhaust ports 25*a*, 25*b* are opened and closed by intake valves 26*a*, 26*b* and exhaust valves 27*a*, 27*b* which are freely slidably provided in the cylinder heads 22*a*, 22*b*.

The intake valves 26*a*, 26*b* and the exhaust valves 27*a*, 27*b* perform opening and closing operations at predetermined intake and exhaust timings when cam mechanisms 29*a*, 29*b* provided to the cylinder heads 22*a*, 22*b* are driven due to the operation of the V-type internal combustion engine 1 in a well-known manner. The intake and exhaust valves thus allow air to be introduced into the combustion chambers 23*a*, 23*b* from the intake runner pipes 13 connected to the intake ports 24*a*, 24*b*, and allow exhaust gas to be discharged from the combustion chambers 23*a*, 23*b* into the exhaust pipes 12*a*, 12*b* connected to the exhaust ports 25*a*, 25*b*.

Exhaust gas is introduced from the exhaust pipe 12*b* into the EGR control valve 14 of the exhaust gas recirculation system through the exhaust-gas introducing pipe 15. By controlling the opening and closing of a valve element 14*a* of the control valve 14, the exhaust gas introduced from the exhaust-gas introducing pipe 15 is directed into a valve chamber 14*b*, and is introduced into a branching chamber 16*b* through a communicating pipe 16*a*. The branching chamber 16*b* is provided with a pair of one-way valves (for example, reed valves) 16*c* for preventing backflow to the branching chamber 16*b*. Supply pipes 17 are connected to the branching chamber 16*b* with the respective reed valves interposed therebetween. The other ends of the exhaust-gas supply pipes 17 communicate with the intake pipes 13 at points near the intake ports 24*a*, 24*b*. The exhaust gas supplied from the supply pipes 17 is introduced from the intake ports 24*a*, 24*b* into the combustion chambers 23*a*, 23*b*.

Figure 4:
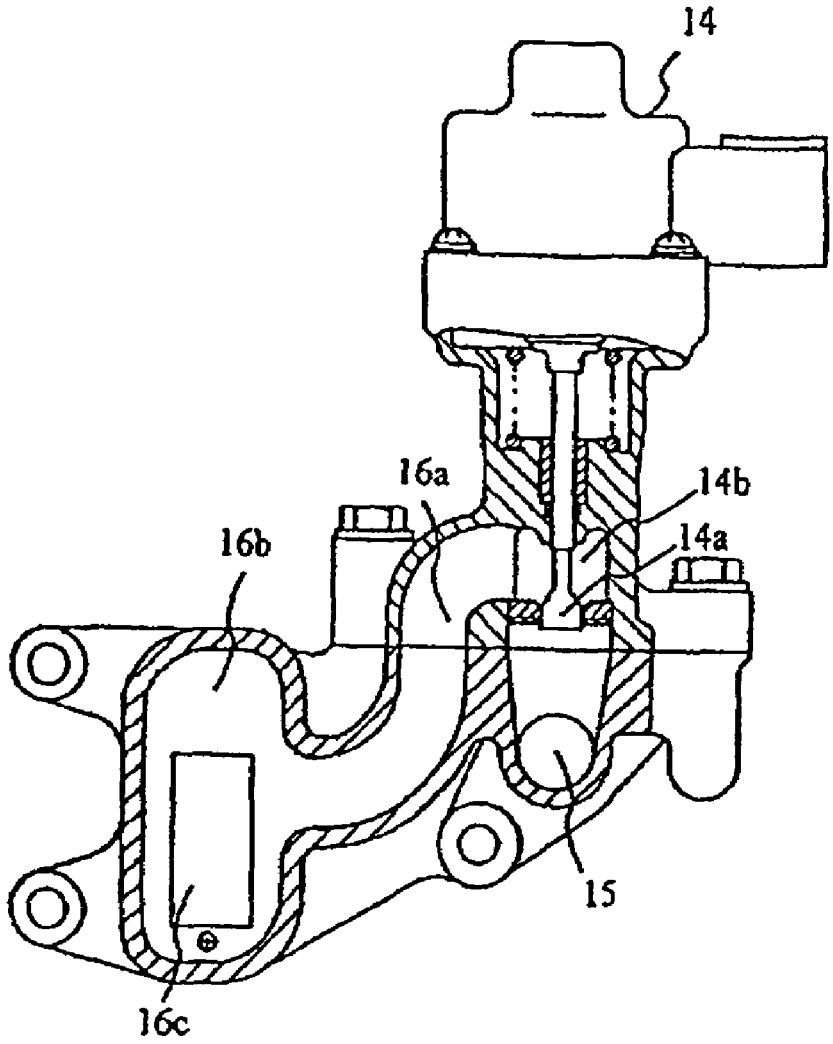
FIG. 4 is a cross-sectional view of the EGR control valve portion of the V-type internal combustion engine according to the embodiment of the present invention, showing the actuator of the EGR control valve disposed above the valve thereof.

In FIG. 4, there is shown a cross-sectional structure of a control valve 14 of the exhaust gas recirculation system ranging from the exhaust-gas introducing pipe 15 to the branching chamber 16*b* as viewed from a direction in which the viewpoint is changed from that of FIG. 1 by 90°.

By controlling the opening and closing of the control valve 14 in accordance with the combustion timing of the internal combustion engine, a proper amount of exhaust gas, introduced from the exhaust pipe 12*b* into the branching chamber 16*b*, is prevented from flowing backward by the reed valves 16*c*, and is recirculated from the exhaust-gas supply pipes 17 into the combustion chambers 23*a*, 23*b* through the intake ports 24*a*, 24*b*.

With regard to the exhaust-gas recirculation system with which the exhaust gas is recirculated into the combustion chambers and recombusted, it is preferable that the temperature of the recirculated exhaust gas be high. Since the exhaust pipe 12*b* is located in a rearward position with respect to the travel direction of the vehicle where the exhaust gas is less cooled by the wind caused by vehicle travel of the motorcycle, and since the exhaust gas to be recirculated is introduced from the exhaust pipe 12*b*, it is possible to minimize cooling of the exhaust gas, and thereby increase the effect of reducing nitrogen oxides (NOx).

As shown in FIG. 1, the cylinder heads 22*a*, 22*b* are provided with charge injectors 30 for injecting a fuel-air mixture into respective combustion chambers 23*a*, 23*b*. The charge injectors 30 include tip portions (injection tips), which feed into the respective combustion chambers 23*a*, 23*b* at the centers thereof. The charge injectors 30, as described later, are controlled and operated with the aid of a solenoid drive, mix the compressed air supplied from the air compressor 18 and the fuel supplied from the fuel tank 7 to make a combustible fuel-air mixture, and directly inject the mixture through the injection tips and into the respective combustion chambers 23*a*, 23*b*.

The cylinder blocks 21*a*, 21*b* are provided on the crankcase 11 with the cylinders spaced apart from each other in a V-shape. In the crankcase 11, a shared compressed-air supply channel 32 is formed in the form of an internal conduit. One end of the shared compressed-air supply channel 32 communicates with the air compressor 18. The other end of the shared channel 32 is opened to a base end portion of the V-shaped space created between the cylinder heads 22*a*, 22*b*.

Compressed-air supply channels 33 are respectively formed in the cylinder blocks 21*a*, 21*b* in the form of internal conduits. Lower ends of the compressed-air supply channels 33 communicate with the shared channel 32 in an airtight manner by the attachment of the cylinder blocks 21*a*, 21*b* to the crankcase 11. For example, the shared channel 32 is formed at the time of casting the crankcase 11, and the compressed-air supply channels 33 are formed at the time of casting the respective cylinder blocks 21*a*, 21*b*.

The compressed-air supply channel 33 branches into two channels at a neighborhood 33*a* of a portion where the cylinder blocks 21*a*, 21*b* meet. The branched compressed-air supply channels 33 extend to the cylinder heads along the side walls of the cylinder blocks 21*a*, 21*b*. In particular, the branched compressed-air supply channels 33 are formed within the sides of the opposed cylinder blocks which face each other. In other words, the branched compressed-air supply channels 33 are formed in the cylinder block side walls on the side thereof adjacent the V-shaped space. In order to provide a clear drawing, in FIG. 1, the compressed-air supply channels 33 are partially shown by dashed lines.

Accordingly, since the compressed-air supply channels 33 are provided in a portion of the internal combustion engine adjacent the V-shaped space, where the heat of combustion of the engine tends to remain and where the influence of cooling by the wind caused by vehicle travel is minimal, it is possible to substantially prevent condensation within the compressed-air supply channels 33 during engine operation, where such condensation might otherwise be caused due to cooling of the compressed air.

As a result of making the compressed-air supply channel in the form of the single shared channel 32 in the crankcase portion, it is made possible to easily machine the crankcase 11. In addition, since compressed air is supplied from the shared channel 32 to the charge injectors 30 through the two compressed-air supply channels 33 which have substantially the same structure, the lengths of the compressed-air supply channels extending from the air compressor 18 to the charge injectors 30 of the cylinders are equalized, so that excellent injection operation of the mixture is enabled.

The upper ends of the compressed-air supply channels 33 open in the surfaces where the cylinder blocks are joined to the cylinder heads. The compressed-air supply channels 34 are provided in the form of internal conduits within the respective cylinder heads 22*a*, 22*b*. By attaching the cylinder heads 22*a*, 22*b* to the respective cylinder blocks 21*a*, 21*b*, the upper ends of the compressed-air supply channels 33 are joined to the compressed-air supply channels 34 formed in the respective cylinder heads 22*a*, 22*b*, so as to communicate with each other in an airtight manner.

Figure 2:
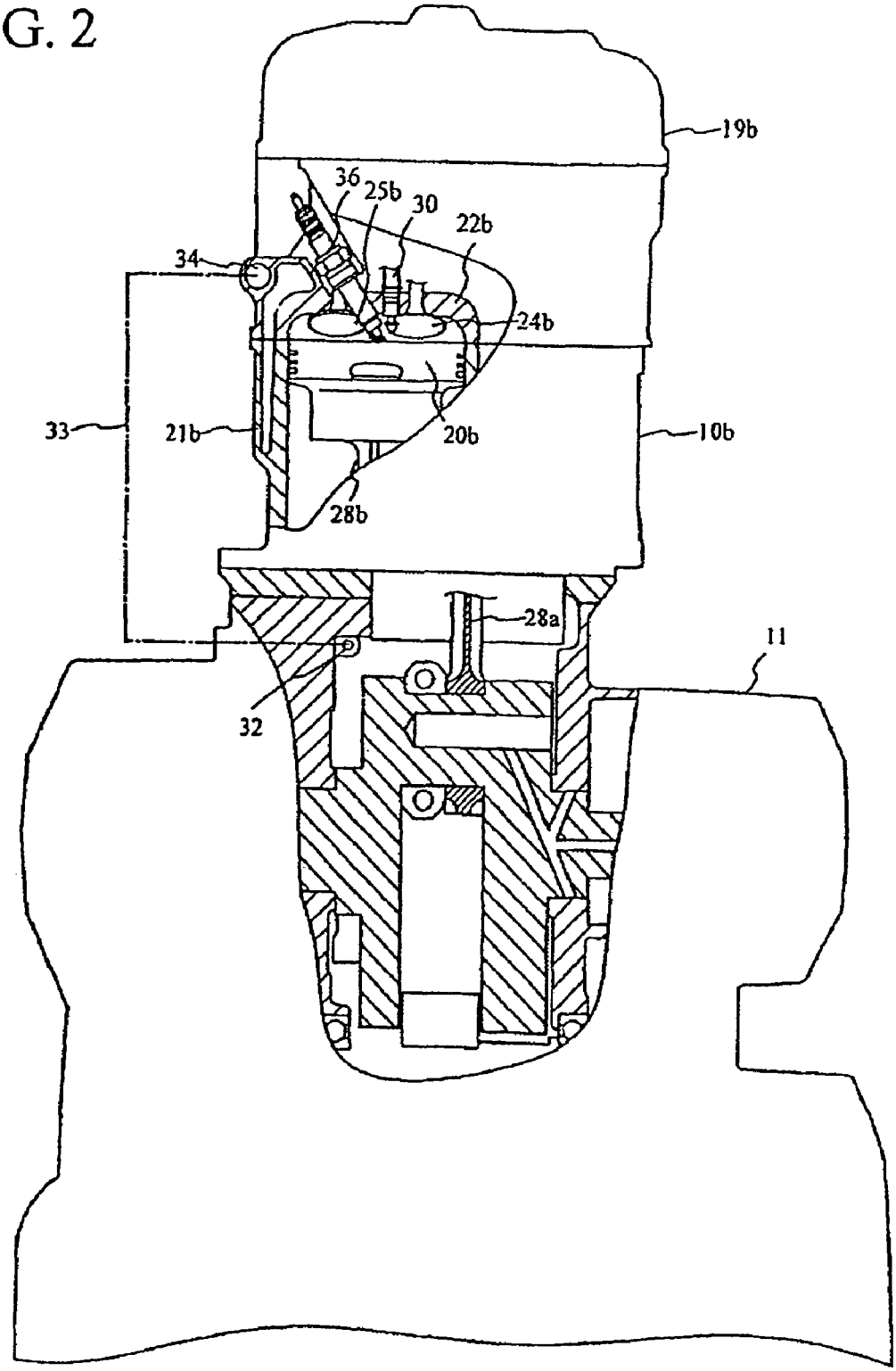
FIG. 2 is a partial cross-sectional front view of the V-type internal combustion engine taken along the line A-A in FIG. 1 showing the configuration of the compressed air channels within the engine.

In FIG. 2, a partial cross section of the V-type internal combustion engine 1 taken along the line A-A in FIG. 1 is shown to explain the relation between the shared channel 32, the compressed-air supply channels 33, and the compressed-air supply channels 34. Specifically, by assembling the internal combustion engine 1 such that the cylinder blocks 21*a*, 21*b* are attached to the crankcase 11, and the cylinder heads 22*a*, 22*b* are attached to the respective cylinder blocks 21*a*, 21*b*, the compressed-air supply channels extending from the air compressor 18 to the charge injectors 30 in the cylinder head portions are formed by cooperation between the shared channel 32, the compressed-air supply channels 33 of the cylinder blocks, and the compressed-air supply channels 34 of the cylinder heads. A spark plug 36 is shown, in FIG. 2, to be facing the combustion chamber at a position proximate the tip of the charge injector 30.

Figure 3:
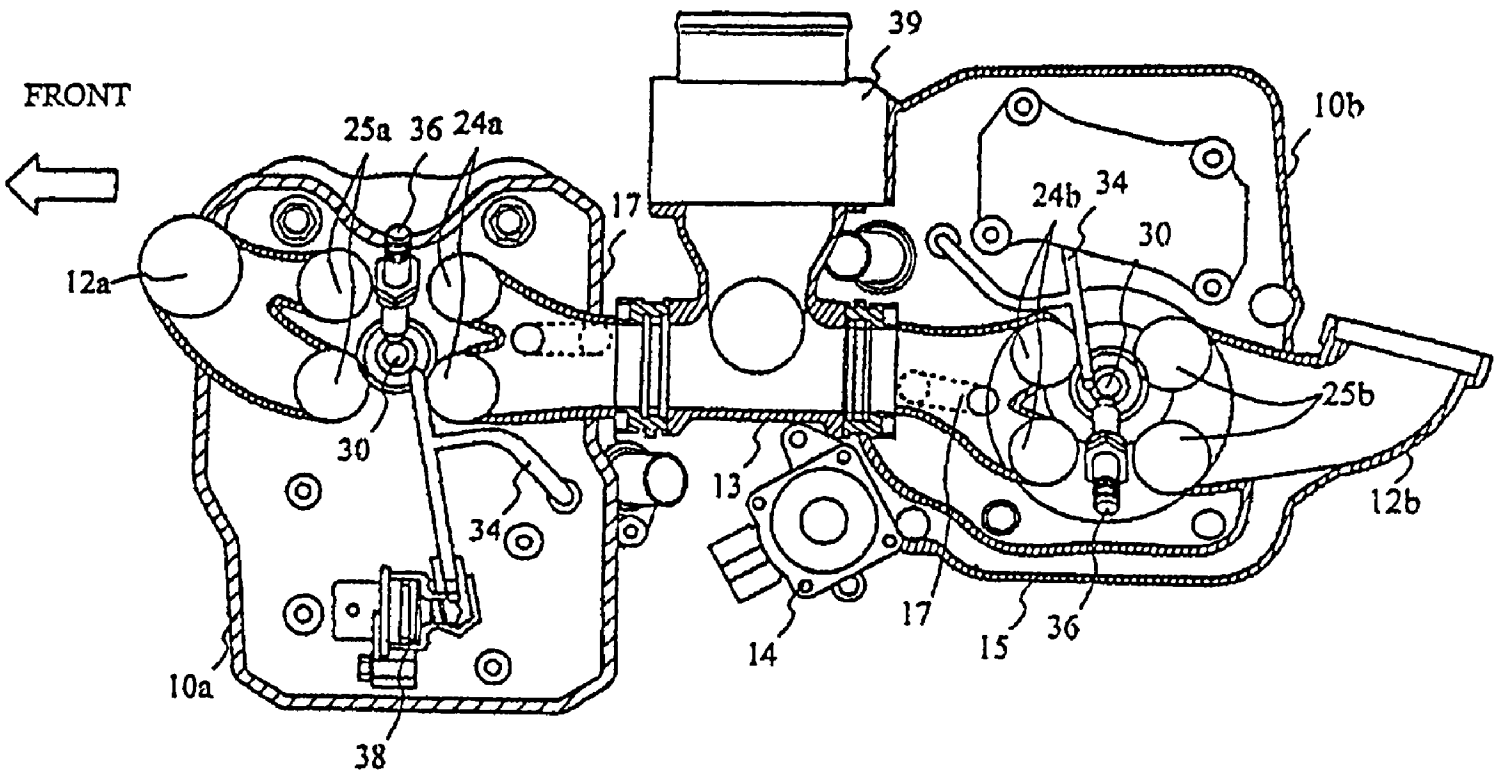
FIG. 3 is a cross-sectional plan view of the V-type internal combustion engine of FIG. 1 showing the regulator for the compressed air channels, and showing pressure regulators connected to the compressed-air supply channels.

The cylinder head portions of the V-type internal combustion engine 1 are shown in a cross-sectional top plan view in FIG. 3, to explain the structure by which the compressed-air supply channels 34 reach the charge injectors 30.

Each of the compressed-air supply channels 34, communicating with the compressed-air supply channels 33 in the cylinder blocks 21*a*, 21*b*, is branched into two channels. One channel is allowed to communicate with an air pressure regulator 38 provided in the cylinder head portion, and the other channel is allowed to communicate with a compressed air chamber of the charge injector 30. That is, the air pressure of the compressed air introduced into the compressed-air supply channels 34 is regulated by the air pressure regulator 38 to a predetermined air pressure, and the pressure-regulated compressed air is supplied to the compressed air chambers of the charge injectors 30.

A throttle valve 39 is provided for regulating the air-intake through the intake feed pipe 13.

Figure 5:
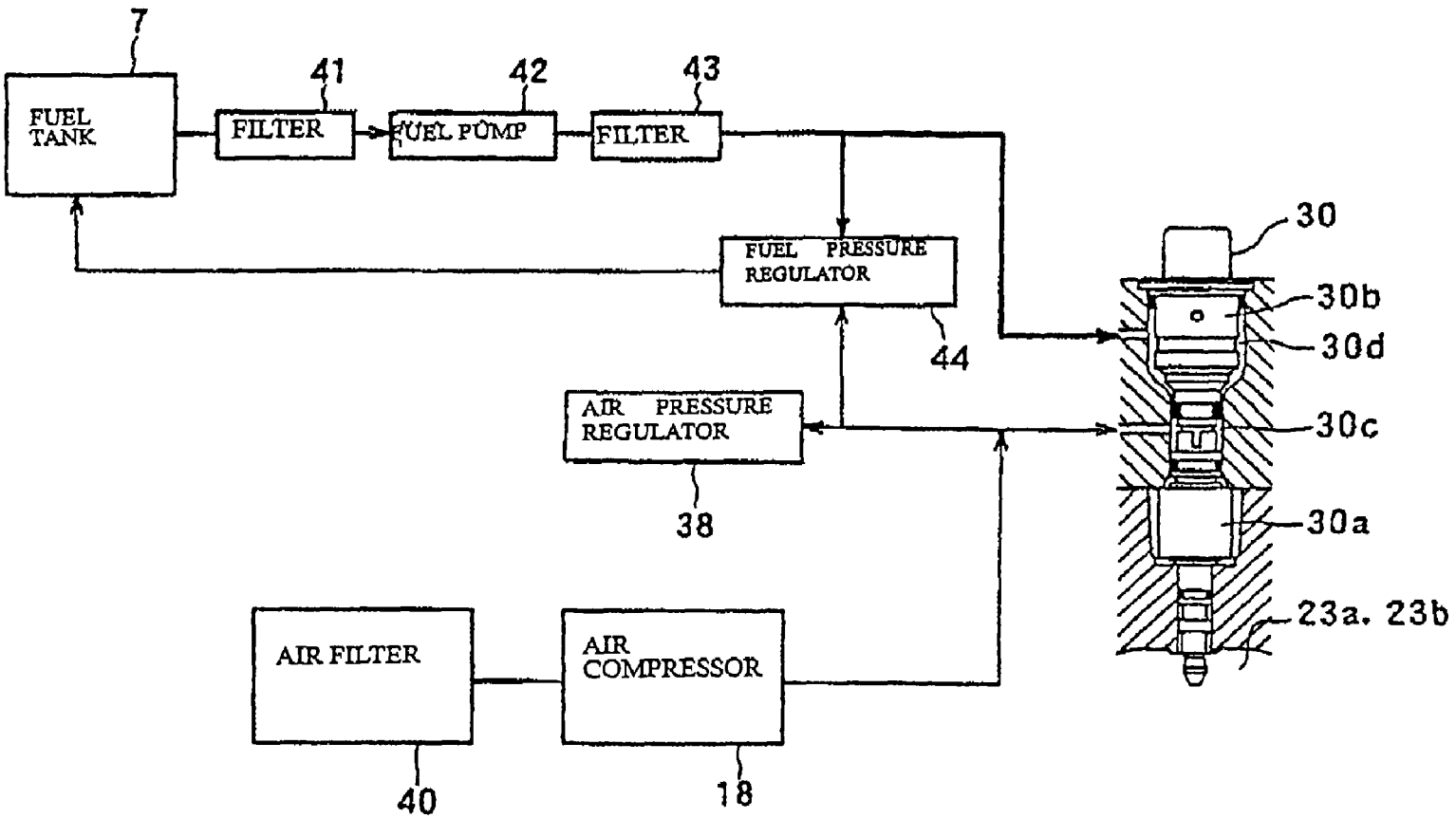
FIG. 5 is a diagram showing a system for supplying compressed air and fuel to a charge injector of the V-type internal combustion engine according to the embodiment of the present invention.

A system for supplying compressed air and fuel to the charge injectors 30 is illustrated in FIG. 5. With reference to FIG. 5, the injection operation of the fuel-air mixture carried out by the charge injectors 30 will be described.

The charge injector 30 includes a mixture valve 30*a*, the lower end of which faces the combustion chamber 23*a* (23*b*). The charge injector 30 also includes a fuel valve 30*b* coaxially provided above the mixture valve 30*a*. The charge injector 30 directly injects the fuel-air mixture, which is made by mixing fuel into compressed air, into the combustion chamber 23*a* (23*b*) by controlling and operating the mixture valve 30*a* and the fuel valve 30*b* via a solenoid (not shown), according to a predetermined timing schedule.

The air taken in through the air filter 40 provided to the motorcycle is compressed by the air compressor 18, and the compressed air is supplied, through the compressed-air supply channel (the shared channel 32, and the supply channels 33, 34), to the compressed air chamber 30*c* of the mixture valve 30*a*. The compressed air is introduced into the air pressure regulator 38 through the branched channel of the supply channel 34 to release excess pressure, so that the pressure-regulated compressed air is supplied to the compressed air chamber 30*c*.

There is a phenomenon in which, when the high pressure air compressed by the air compressor 18 is cooled, the moisture contained in the compressed air precipitates out of the air and condenses to form dew. However, since the compressed-air supply channel 32, 33, 34 is formed in the crankcase 11, the cylinder blocks 21*a*, 21*b*, and the cylinder heads 22*a*, 22*b*, where the combustion operation of the internal combustion engine produces a heating effect during engine operation, and is formed in a place where the influence of cooling by the wind caused by vehicle travel is small, the formation of condensation in the supply channels extending from the air compressor 18 to the charge injectors 30 is substantially prevented, so that the compressed air can be smoothly supplied to the charge injectors 30.

Meanwhile, a fuel pump 42 is provided to the motorcycle that takes in fuel from the fuel tank 7 through a fuel filter 41. The fuel pumped by the fuel pump 42 is supplied to a fuel chamber 30*d* formed by the fuel valve 30*b*. A portion of the fuel channel is split from the channel reaching the fuel injection valve 30, whereby the fuel is introduced to a fuel pressure regulator 44 to return excess fuel to the fuel tank 7. The pressure of the fuel is regulated so that the fuel pressure is higher than the air pressure in the compressed air chamber 30*c*, and so that the pressure difference therebetween is kept constant. In this way, the pressure-regulated fuel is supplied to the fuel chamber 30*d*.

Once the solenoid is energized, and the fuel valve 30*b* is thus opened while the compressed air is supplied to the compressed air chamber 30*c*, and the fuel is supplied to the fuel chamber 30*d* in the above described way, the fuel measured via the fuel chamber 30*d* is injected into the compressed air chamber 30*c*, so that the fuel and the compressed air are mixed.

Subsequently, once the solenoid is energized, and the mixture valve 30*a* is thus opened, the fuel-air mixture in the compressed air chamber 30*c* is injected into the combustion chambers 23*a*, 23*b* because of the pressure thereof. Once the mixture is in the combustion chambers 23*a*, 23*b*, it is ignited by the spark plug 36, and burns.

While a working example of the present invention has been described above, the present invention is not limited to the working example described above, but various design alterations may be carried out without departing from the present invention as set forth in the claims.

What is claimed is:

1. An internal combustion engine, comprising:

a crankcase, a plurality of cylinders provided on the crankcase, the cylinders spaced from each other in a V-shape such that a substantially V-shaped space exists between the cylinders, each of the cylinders comprising a cylinder head disposed on a cylinder block, a charge injector disposed within each of the cylinder heads, the charge injector constructed and arranged to directly inject a fuel-air mixture into a combustion chamber in the cylinder during engine operation, an air compressor operatively attached to the engine, and compressed-air supply channels, comprising a first and second part, extending between the air compressor and each of the charge injectors, respectively, for supplying compressed air from the air compressor to the charge injectors, wherein the first part of said compressed-air supply channels is provided in the form of a single shared channel formed within the crankcase, and the second part of said compressed-air supply channels is branched to form plural branched channels, each branched channel extending between the single shared channel and a respective charge injector, each branched channel comprising an internal conduit formed within the cylinder wall.

2. The internal combustion engine according to claim 1, wherein the second part of the compressed-air supply channels are provided along side walls of the respective cylinder blocks, and are formed within the cylinder block side walls on the V-shaped space side of the respective cylinder blocks.

3. The internal combustion engine according to claim 1, wherein the air compressor is provided, in an exposed manner, in a front portion of the internal combustion engine with respect to a travel direction of a vehicle when the internal combustion engine is mounted on a vehicle.

4. The internal combustion engine according to claim 1, wherein each branched channel comprising an air pressure regulator so that pressure-regulated compressed air is directed to the charge injector of each cylinder.

5. The internal combustion engine according to claim 1 wherein the compressed-air supply channels for supplying compressed air from the air compressor to the charge injectors comprise pressure regulators, and wherein the engine further comprises a fuel pump and a fuel regulator, the fuel pumped by the fuel pump is directed to the charge injectors and is regulated by the fuel regulator such that the fuel pressure is higher than that of the air pressure within the compressed air supply channels, and the difference in pressure between the fuel and the compressed air remains substantially constant.

6. An internal combustion engine, the engine comprising a crankcase, a plurality of cylinders provided on the crankcase, the cylinders spaced from each other in a V-shape such that a V-shaped space exists between the cylinders, each of the cylinders comprising a cylinder head disposed on a cylinder block, a charge injector disposed within each of the cylinder heads, the charge injector directly injecting a fuel-air mixture into a combustion chamber in the cylinder, an air compressor annexed to the engine, and compressed-air supply channels formed therein for supplying compressed air from the air compressor to the charge injectors, the compressed-air supply channels comprising a single shared channel disposed within the crankcase, one end of the shared channel communicating with the air compressor, the other end of the shared channel terminating at, and opening to, a joint between the crankcase and the cylinder blocks, plural branched channels disposed within the cylinder blocks, one end of each branched channel communicating with the single shared channel, and an other end of each branched channel communicating with a charge injector such that a branched channel is provided in each cylinder block.

7. The internal combustion engine of claim 6, wherein each of the plural branched channels comprise a lower portion and an upper portion, wherein the lower portion is disposed within the respective cylinder block, one end of the lower portion communicating with the single shared channel, and an other end of the lower portion terminating at, and opening to, a joint between the respective cylinder block and the corresponding cylinder head, the upper portion is disposed within the corresponding cylinder head, one end of the upper portion communicating with the other end of the lower portion, and an other end of the upper portion communicating with the charge injector, wherein the upper portion is further connected to an air pressure regulator which regulates the pressure of the compressed air such that pressure-regulated compressed air is delivered to the charge injector.

8. The internal combustion engine of claim 7 wherein the engine further comprises a fuel pump and a fuel regulator, and the fuel pumped by the fuel pump is directed to the charge injectors and is regulated by the fuel regulator such that the fuel pressure is higher than that of the air pressure within the compressed air supply channels, and the difference in pressure between the fuel and the compressed air remains constant.

9. The internal combustion engine of claim 7 wherein the single branched channel is formed by casting within the crankcase, the lower portion of the plural branched channels is formed by casting within each cylinder block, and the upper portion of the plural branched channels is formed by casting within each cylinder head, such that when the internal combustion engine is assembled with the cylinder blocks joined to the crankcase, and with the cylinder heads joined to the cylinder blocks, then the branched channel communicates with the lower portions of the plural branched channels in an airtight manner, and the lower portions of the plural branched channels communicates with the upper portions of the plural branched channels in an airtight manner.

10. The internal combustion engine of claim 6, wherein the plural branched channels are disposed within the cylinder blocks along side walls of the respective cylinder blocks, and are formed within the cylinder block side walls on the V-shaped space side of the respective cylinder blocks.

11. The internal combustion engine according to claim 6, wherein the air compressor is provided, in an exposed manner, in a front portion of the internal combustion engine with respect to a travel direction of a vehicle when the internal combustion engine is mounted on a vehicle.

12. The internal combustion engine according to claim 6 wherein the shared channel and the branched channels comprise conduits formed within the interior of the internal combustion engine.

* * * * *